United States Patent [19]

Tănăsescu et al.

[11] Patent Number: 4,658,742

[45] Date of Patent: Apr. 21, 1987

[54] ELECTRONIC CONTROLLING EQUIPMENT FOR DRIVING SYSTEMS WITH ELECTROMAGNETIC COUPLINGS FOR INDUSTRIAL SEWING AND/OR OVERCASTING MACHINES

[75] Inventors: Florin T. Tanasescu; Laurentiu Vatafu Gaitan; Dumitru Stefanescu, all of Bucharest, Romania

[73] Assignee: Institutul de Cercetare Stiintifica si Inginerie Tehnologica Pentru Industria Electrotehnica-ICPE, Bucharest, Romania

[21] Appl. No.: 662,403

[22] PCT Filed: Jan. 24, 1984

[86] PCT No.: PCT/RO84/00001

§ 371 Date: Sep. 24, 1984

§ 102(e) Date: Sep. 24, 1984

[87] PCT Pub. No.: WO84/02933

PCT Pub. Date: Aug. 2, 1984

[30] Foreign Application Priority Data

Jan. 24, 1983 [RO] Romania ..... 109813

[51] Int. Cl.[4] ..... D05B 69/22

[52] U.S. Cl. ..... 112/275; 112/239; 112/300

[58] Field of Search ..... 112/275, 277, 300, 121.11, 112/220, 237, 239; 318/614, 305; 338/12

[56] References Cited

U.S. PATENT DOCUMENTS

| | | | |
|---|---|---|---|
| 3,761,790 | 9/1973 | Daab | 112/275 X |
| 4,014,277 | 3/1977 | Morinaga et al. | 112/277 |
| 4,080,914 | 3/1978 | Ishida et al. | 112/300 X |
| 4,228,385 | 10/1980 | Angersbach et al. | 318/614 |
| 4,578,624 | 3/1986 | Neki et al. | 112/277 X |

*Primary Examiner*—Peter Nerbun

*Attorney, Agent, or Firm*—Karl F. Ross; Herbert Dubno

[57] ABSTRACT

The invention relates to an electronic system for the continuous speed control, with stopping at fixed preselected points for industrial sewing and/or overcasting machines. The invention also relates to a system which can afford additional control of the electromagnetic operational components e.g. the presser foot, of cutting device and of thread loosening device, using a driving system with an asynchronous motor and an electromagnetic coupling.

10 Claims, 4 Drawing Figures

ELECTRONIC CONTROLLING EQUIPMENT FOR DRIVING SYSTEMS WITH ELECTROMAGNETIC COUPLINGS FOR INDUSTRIAL SEWING AND/OR OVERCASTING MACHINES

BACKGROUND OF THE INVENTION

As is known, electronic equipment for the control of the driving systems with electromagnetic couplings for industrial sewing and/or overcasting machines, have many advantages including the ability to make speed adjustments, the selection of the stopping points and controls for the additional operations; however they do not allow a continuous speed adjustment. The dynamic parameters do of earlier systems do not allow the intensive use of the machine and the number of components is therefore increased.

OBJECTS OF THE INVENTION

It is, therefore, the principal object of the present invention to provide continuous speed control for industrial sewing with a simple contactless control device.

Another object of this invention is to provide a system for the purposes described with improved dynamic parameters and, therefore, a rapid response to the controls and high efficiency.

Still another object of this invention is simplicity in construction, employing a minimum number of components in an optimized scheme, ensuring high efficiency and safety in operations.

Yet another object is to employ the same scheme for a very wide range of powers and speeds, by adequate adjustment of the terminal amplifiers.

SUMMARY OF THE INVENTION

These objects and others which will become apparent hereinafter are attained, in accordance with the present invention, with an electronic system for the control of the driving system and electromagnetic coupling of industrial sewing and/or overcasting machines.

According to the invention, it is able to perform a continuous speed control with improved dynamic parameters by employing an optimized scheme which ensures high economic efficiency and safety in operation.

The invention is contactless and employs electromagnetic sensors for speed detection and armature position detection. The foot pedal is the machine operator's input device for varying the speed, lifting the presser foot, thread loosening and thread cutting.

The speed control device consists of a speed regulator, with signal inputs from a comparator and a logic circuit, and two power amplifiers, one controlling the brake mechanism and the other controlling the clutching mechanism.

The logic circuit, with input signals from the foot pedal, speed transducer and armature position transducer, control the machine's scheme of interconditioning and interblocking.

SPECIFIC DESCRIPTION

Figure 1:
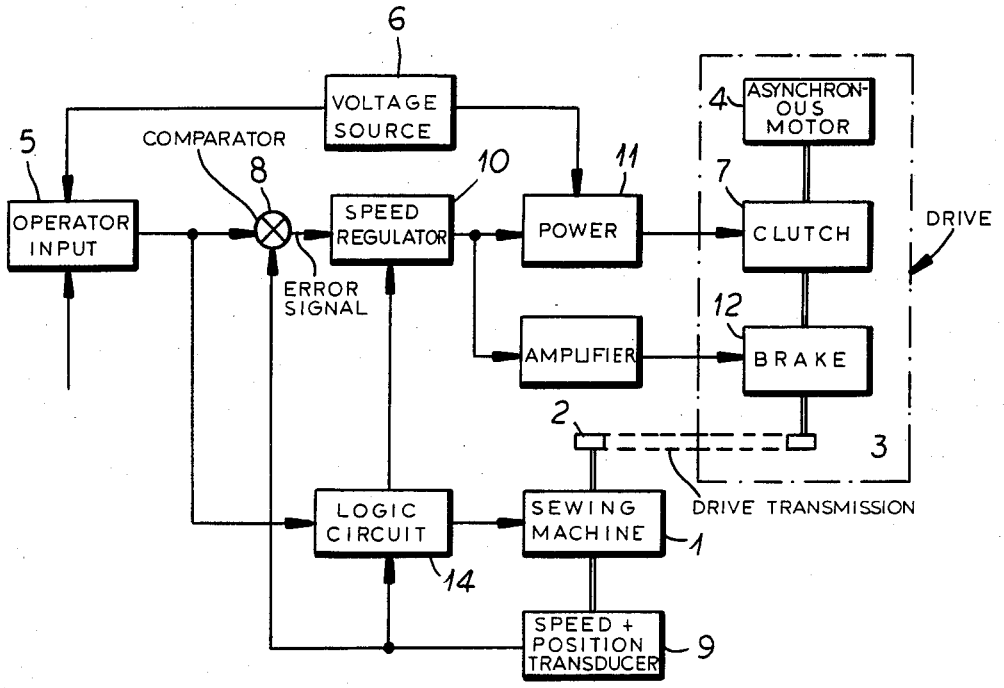
FIG. 1 is a block diagram of an electronic equipment for the control of the driving system.

In accordance with the invention, a machine 1 is connected by a transmission system 2 with a driving system 3. The driving system has an asynchronous motor 4, clutch 7 and a braking mechanism 12. The machine is controlled by the machine operator through input means 5. The operator can control the machine speed and lifting of the presser foot, cutting of the thread with a scissors and thread loosening.

As the operator changes the speed, the actual speed is compared to the desired speed (set point from input means 5) in comparator 8. The speed signal is generated by the speed and position transducer 9. An error signal in proportion to the difference is used by the speed regulator 10 to adjust the speed of the machine. The power amplifiers 11 and 13, which control the clutch 7 and braking mechanism 12 respectively, responds to control signals from the speed regulator 10. A voltage source 6 supplies both the controller 5 and power amplifier 11.

The logic block 14 receives control signals by the operator from control device 5. The logic block also receives speed and position signals from the speed and position transducer 9. The logic block also controls lifting of the presser foot, driving of the scissor and loosening the thread of the machine 1. The stopping at a fixed, preset point is effected by the logic block 14 through the speed regulator and amplifiers controlling the brake mechanism 12 and clutch 7.

Figure 2:
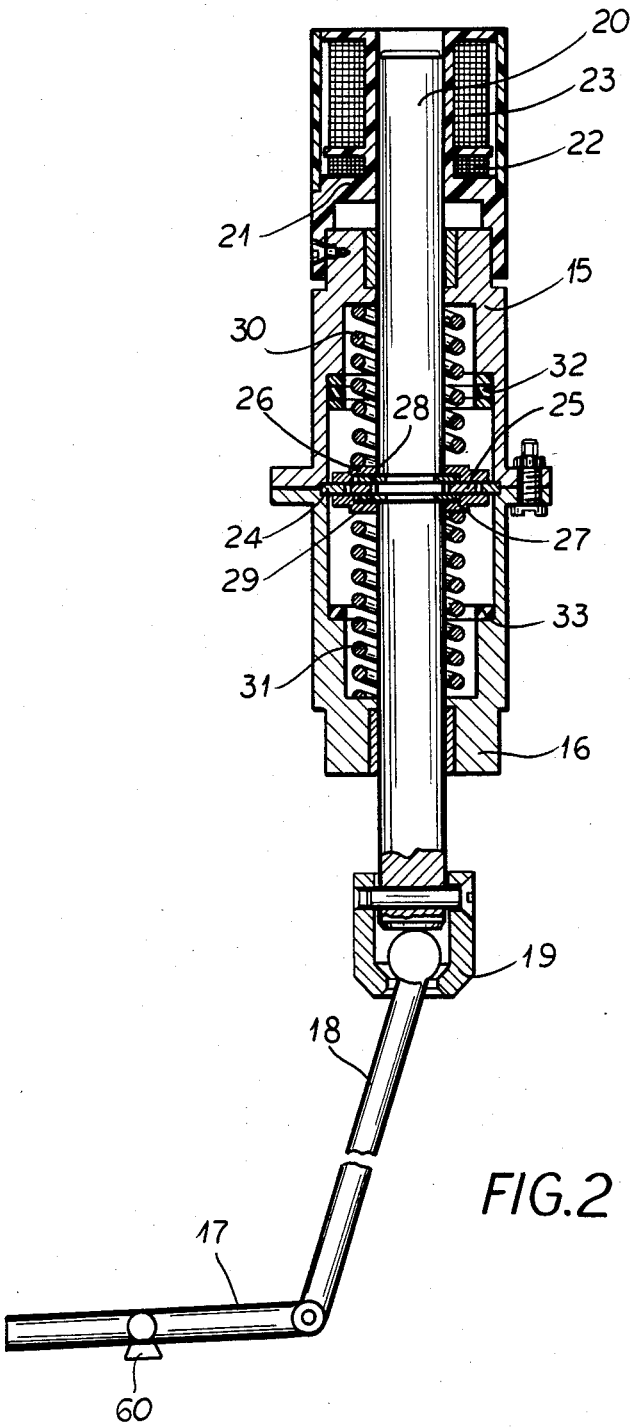
FIG. 2 is a control device of the input commands, without contacts.

In accordance with the invention, the input commands for speed and additional controls are achieved from the control device 5, which is contactless. Control device 5 is shown in FIG. 2. The structure consists of an upper section 15 and a lower section 16, which is fastened to the board of the machine 1. The control device is displaced by the operator by pedal 17 which is hinged at a fulcrum 60. The pedal is coupled to rod 18, which has a spherical end in sleeve 19. A ferromagnetic shaft 20, which is positioned coaxially in the structure, is linked to the spherical end of rod 18 in the sleeve 19. The pedal 17 is pushed forward for speed control and back for the other controls. The ferromagnetic shaft 20 inductively couples the two coil, primary coils 22 and secondary coil 23, mounted on the common support 21.

The primary coil is supplied by a rectangular waveform voltage source 6. The undriven position is obtained by the ring-shaped washers 24, 25, 26 and 27 and by safety washers 28 and 29.

The return to the initial state is performed by compression springs 30 and 31, working independently. The displacement stroke is constrained by the dimension of the upper structures, lower structure and rubber stopping gaskets 32 and 33.

Figure 3:
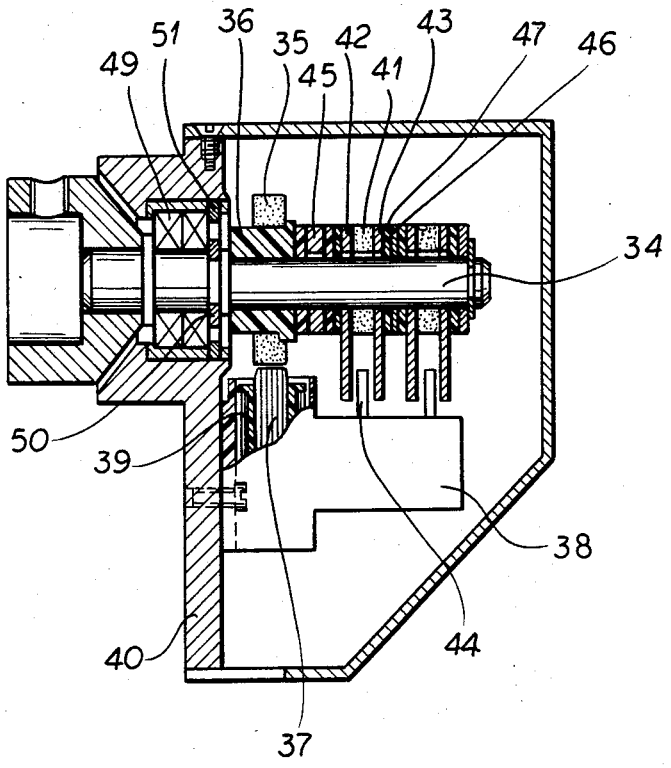
FIG. 3 is a speed and position transducer.
Figure 4:
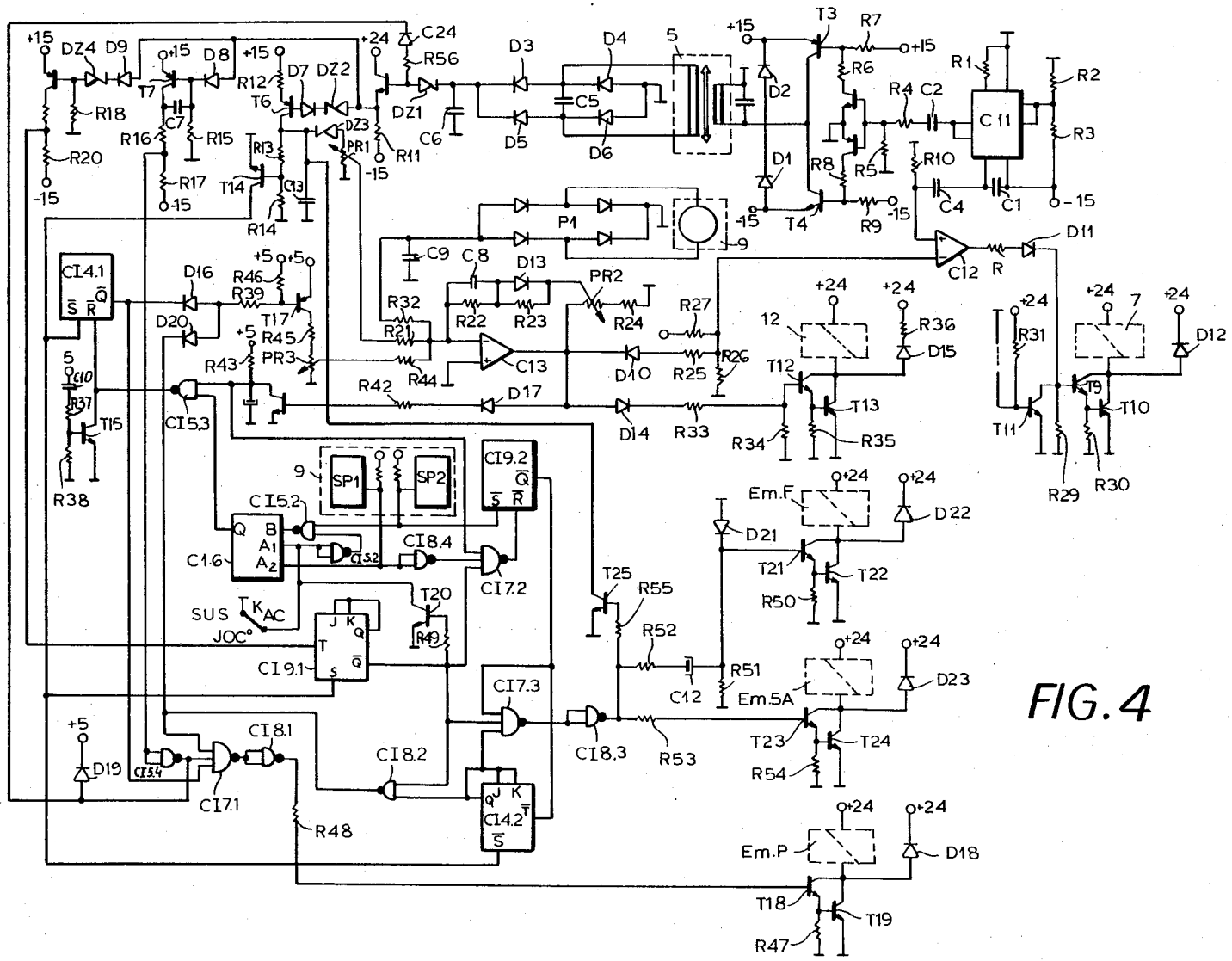
FIG. 4 is an electronic circuit diagram of the control system.

The contactless inductive speed and position transducer is shown in FIG. 3. The transducer consists of a nonmagnetic shaft 34, rotoric inductive armature and a ferrite magnet 35. The magnet is radially magnetized and multipolar with 2p poles and fastened to an insulating sleeve 36. The armature consists of a magnetic yoke 37 with a winding 39, and has at least one and at most 2p poles juxtaposed with the magnet 35. The yoke is mounted in structure 38.

The voltage output of winding 39 has an amplitude and frequency in proportion to the speed of shaft 34. The amplitude value of the output voltage can be adjusted by modifying the air-gap between certain limits, depending on the pole pitch, by shifting the structure 38 relative to support 40 of the transducer.

The magnetic position transducer is mounted on the same shaft 34 of as the speed transducer. Thus the shaft 34 can carry a ring-shaped ferrit magnet 41; which is axially magnetized and flanked by two ferromagnetic pieces 42 and 43 which concentrate the flux. In to the magnetic field so generated, which rotates together with the shaft 34 penetrates a Hall effect magnetic sensor 44 with an incorporated amplifier, mounted on the structure 38. The magnetic sensor 44 delivers an output in the form of a constant amplitude pulse at each rotation which is dependent on the relative angular position between the flux concentrator 42, 43 and the magnetic sensor 44. Similar transducers can be mounted on shaft 34 to detect additional positions. The relative position can be adjusted, and secured by some spacing pieces 45, 46 and by the rubber pressing washer 47. The transducer shaft 34 is mounted on the support 40 by means of bearings 49, blocked by some safety washers 50, 51.

According to the invention, the electronic control circuit allows the following operations to be performed by the driving system:

continually variable speed, between the minimum speed called positioning speed and the maximum speed, with the stopping of the system and of the needle too, the transmission ratio between the two movements being 1:1 in a preset position "up" or "down", when the pedal is pushed "forward";

the lifting of the presser foot, when the pedal is moved "back" in an intermediary position;

the scissor operation and the thread loosening when the pedal is fully back;

At the same time, the mechanical construction of the machine head imposes some constraints;

when the system operates at the selected speed it is impossible to lift the presser foot, whose normal position is "down";

so long as the pedal is held in the intermediate position "back", the presser foot is lifted; however when the scissor is driven the footlet drops, then it returns in the position "up";

if the driving system, hence the sewing machine is inactivated in the position "down", at the thread cutting control. The system passes and moves into the position "up", performimng a half rotation; during this half rotation the scissors are driven so the thread cutting is carried out;

if the system stops in the position "up", at the thread cutting control, the system will perform an entire rotation, the thread is cut when the system shifts from the position "down" in to the position "up";

at the thread cutting control the system shifts in the position "up" only by the positioning speed;

the thread being cut, the operation cannot be repeated, even if the pedal returns in the maximum position "back"; a new control for cutting is performed only if the system is driven again "forward" by the pedal;

when the pedal passes rapidly from the position "forward" to the position "back" the thread cutting control is performed only after the positioning speed is reached and the position "up" is detected.

In accordance with the invention, a PLL type integrated circuit C11, together with some resistances R1, R2, R3 and a capacitor C1 ensure both the rectangular supplying voltage of the initial winding 22 of the control system 5 through transistors T1, T2, T3 and T4, resistances R4, R5, R6, R7, R8, R9, capacitors C2, C3 and diodes D1, D2. The sawtooth reference voltage for chopping is applied to the speed control loop at the input of an operational amplifier C12 by a resistance R10 and a capacitor C4.

According to the invention, by driving "forward" the pedal 17, a progressively increasing voltage is developed depending on the displacement of the pedal 17. This voltage is processed by a rectifying and filter means consisting of diodes D3, D4, D5, D6, capacitors C5, C6, Zener Diodes Dz1, Dz2, Dz3, resistors R11, R12, R1, R14, transistors T5, T6 and a diode D7. The value of this voltage, applied therefore at the input of an operational amplifier CI3, can be adjusted by a potentiometer PR1. When the pedal 17 is driven "back" by means of the control device 5, two step voltage signals are developed from the signal from filter means consisting of the emitter of the transistor T5, by a diode D3 by means of the transistor T7 of a capacitor C7, of resistors R15, R16, R17 respectively of a diode D9, of a Zener diode DZ4, of a transistor T8, of resistors R18, R19, R20, as reference values for the additional controls. The first signal controls the footlet EnP. The second signal controls the scissors EnFF and the thread loosening EnSA. At the same time, the voltage variability curve depending on the distance has an insensitve zone near the position O of the pedal 17.

According to the invention, the speed adjustment means consists of an operational amplifier CI3, with an input resistor R21, resistors R22, R23, R24, a capacitor C8 and a potentiometer PR2, (for adjustment of the amplification coefficient) a diode D10, resistors R25, R26, R27; an operational amplifier CI2 and a resistor R28, another diode D11; and the terminal amplifier formed by some transistors T9, T10, resistors R29, R30 and a reclaiming diode D12 supplying the electromagnetic coupling clutch 7. A transistor T11 and a resistor R31 blocks the terminal amplifier when the speed and position transducer is not connected with the electrical assembly. The voltage delivered by the speed transducer, after rectification by means of a rectifying bridge R1 and filter by means of a capacitor C9, is applied at the input of operational amplifier CI3 by means of a resistor R32. The braking circuit closes in the open loop by the operational amplifier CI3, the resistor R22, a diode D13, that produce a very high amplification coefficient, a diode D14, a resistance R33 and the terminal amplifier, (formed by some transistors T12, T14, resistors R34, R35, R36 and a diode D15) supplying the braking electromagnetic coupling 12.

In accordance with the invention, the driving system 3 can be stopped in either the "down" or "up", preselected position as determined by revolving switch $K_{AC}$. This is done from the positioning speed by a transistor T14. The system returns to position O when transistor T15, resistors R37, R38, R39, capacitor C10 and diode D16, apply a voltage to trigger circuit CI4.1.

A signal representing the position of the shift is generated by sensors SP1 and SP2 of transducer 9 which is supplied by resistors R40 and R41. The signal generated by sensor SP2 is used an an input to monostable circuit CI6 through CI5.1 and CI5.2. The signal generated by sensor SP1 is directly inputted to monostable circuit CI6. The output of CI6 is inputted to CI5.3. Circuit CI5.3 is conditioned by the absence of the braking signal of operational amplifier CI3, by blocking a diode D17, transistor T16, resistors R42, R43 and capacitor C11.

Circuit CI5 cancels the initial control of trigger circuit CI4.1. The reference value of the position speed is applied by transistor T17, resistors R44, R45 and R46 and the input of operational amplifier CI3. The minimum level of this value is adjusted by potentiometer PR3.

According to the invention, the signal for lifting the presser foot is supplied by the control device 5 by pushing the pedal 17 in to an intemediary position "back". The Zener diode DZ1, transistor T5, resistor R11 and diode D8 then create a first step voltage. The step voltage signal controls the presser foot resistor R16, transistor T7, circuit SI, CI5.4, CI7.1, CI8.1, diode 1 and a Darlington Amplifier. The Darlington Amplifier consists of two transistors T18, T19, two resistors R47, R48 and diode D18. The presser foot is lifted only if the driving system 3 has not received the speed or position control which is detected by trigger circuit CI4.1 and only if the control for the scissor drive was not effected, by trigger circuit CI4.1 and SICI8.2.

According to the invention, by pushing the pedal 17 "back" in the maximum position, Zener diode 1, transistor T5, resistor R11, diode D9 and Zener diode DZ4 generate a second voltage step. The stopping in the "up" position is controlled by means of transistor T8, a trigger circuit CI9.1, a circuit SICI7.2, another trigger circuit CI9.2, circuits SICI7.5, circuits CI8.3, transistor T20 and resistor R49. The control pulse is initiated for the scissor operation and thread loosening, only if the control for the braking was not done and if sensor SP1 has detected the position "down" for the needed state, which is transmitted by circuit SICI8.4

The trigger circuit memorizes the cutting control, regardless of the subsequent position of the pedal 17, ensured by the circuit SICI8.2 and a diode D20. The signal for ceasing of the scissors drive and thread loosening device is controlled by the position sensor SP2, trigger cituict CI9.2, CI4.2, and the circuits SICI7.3, after the control for the stopping of the needle in the position "up" is done by the transistor T20. A new signal for the scissors drive and the thread loosening can again be generated ony after the pedal 17 is shifted "forward". Transistor T14 should then return the position O to the trigger circuits CI9.1 and CI4.2. The two signals act by two terminal amplifiers the first formed by two transistors T21, T22, two diodes D21, D22, three resistors R50, R51, R52 and a capacitor C12 supplying an electromagnet for the drive of the scissors EmF. The second consisting of two transistors T23, T24, a diode D23 and two resistors R53, R54, supplying an electromagnet EmSA for controlling the thread loosening device.

According to the invention, by transistor T16 and circuit SICI7.2, the control for the scissors drive and thread loosening can be done only when braking the positioning speed. Trigger circuit CI9.1 detects when pedal 17 is pushed suddenly from the position "forward" in the position "back".

According to the invention, when the pedal 17 passes suddenly through the positions "forward", "maximum back". "forward", at the beginning, the control for the scissors drive and for thread loosening can be performed. The second control for speed being can only perform after completing the first control, as detected by a transistor T25, having a resistor R55, the transistor cancels the collector of the transistor T6, and capacitor CI3 as diode D24 and the resistor R56 react positively in the control circuit.

We claim:

1. A device for continuous speed control and control of presser foot lifting, thread loosening and thread cutting for an industrial sewing machine with electromagnetic coupling and a first shaft comprising:

an operator input means for controlling said machine;

an asynchronous motor for driving said machine;

a clutch coupled to said asynchronous motor;

a transmission system;

a braking mechanism coupled to said clutch and coupled to said machine by said transmission system;

an inductive speed and position transducer coupled to said machine for detecting speed of said machine and position of said first shaft;

a comparator coupled to said speed and position transducer and said input means, for comparing said speed with a desired speed as established by said input means;

a logic block coupled to said input means, said machine and said speed and position transducer for controlling said presser foot lifting, said thread loosening and said thread cutting;

a speed regulator coupled to said comparator and said logic block for regulating said speed;

a first power amplifier coupled to said speed regulator and said clutch;

a second power amplifier coupled to said speed regulator and said braking mechanism; and a voltage source coupled to said first power amplifier and said input means, said operator input means including a foot pedal, an elongated support having a longitudinally extending passage, a ferromagnetic rod displaceable in said passage parallel to a longitudinal axis of said support, a primary and a secondary coil surrounding said passage and offset along said axis, said primary coil being coupled to said voltage source, and a link coupling said ferromagnetic rod and said pedal, said speed and position transducer comprising:

a nonmagnetic second shaft coupled to said first shaft, a permanent magnet mounted on said second shaft and rotatable therewith, a stator being juxtaposed with said permanent magnet and having a coil with an output proportional to the speed of said first shaft, and an axially magnetized magnet carried by said second shaft and formed with ferromagnetic pieces flanking said axially magnetized magnet, a Hall-effect transducer extending between said pieces and having an output signaling the position of said first shaft, a housing having a longitudinally extending passage, a nonmagnetic second shaft rotatable in said passage, coupled to said first shaft and surrounded by a magnetic rotor armature, and a ring-shaped permanent magnet surrounding said second shaft, axially magnetized, having on a first side a first ferromagnetic piece and on a second side a second ferromagnetic piece, said first and second ferromagnetic pieces concentrating the flux of said ring-shaped magnet;

a rotoric inductive armature consisting of magnetic yokes being winded with a multiplicity of coils, whereby the electrical output of said coils is proportional to said speed of said first shaft; and a magnetic sensor mounted in said housing parallel to said ring-shaped permanent magnetic for detecting the position of said first shaft.

2. A device as defined in claim 1 wherein said voltage source supplies said primary coil with a rectangular voltage.

3. A device as defined in claim 1 wherein said logic block comprises:

rectifying means coupled to output of said secondary coil, for rectifying said output;

a first filter means coupled to said rectifying means, and said speed regulator, for developing a continuously growing voltage, depending on displacement of said pedal when said pedal is driven forward;

a second filter means coupled to said rectifying means for developing a first step voltage signal and a second step voltage signal when said pedal is driven back, wherein said first step voltage signal controls said presser foot lifting; and gate means coupled to said second filter means and said speed and position transducer for processing said second step voltage signal and controlling said thread loosening and said thread cutting.

4. Electronic equipment for continuous adjustment of speed, braking and stopping in a pre-set position and controls for presser foot lifting, thread loosening and thread cutting for a driving system having electromagnetic clutches for an industrial sewing and/or overcasting machine comprising:

a contactless input device mechanically connected to the foot pedal controlling said sewing machine;

an asynchronous electric motor driving said sewing machine;

an electromagnetic clutch for coupling the shaft of said motor to the output shaft of said driving system;

a second electromagnetic clutch for braking said output shaft;

a transmission system located between the motor shaft and the shaft of said system;

an inductive speed transducer and a position transducer having a magnetic sensor mounted on the machine shaft detecting the speed and the position of said machine shaft;

a comparator having applied to one of its inputs the input value of said input device and to the other input the reaction value for the speed of said transducer;

a control logic having as input value the output value of said input device and the reaction values of speed and position of said transducer, said transducer performing all controlled functions and interblocking constraints imposed by said sewing machine, said control logic cooperating with said input device so that front and back movement of said foot pedal controls the speed of said sewing machine, movement of said foot pedal into an intermediate back position automatically raises said presser foot, and further movement of said foot pedal into an extreme back position effects thread loosening and thread cutting;

a speed regulator having as input values the error signal provided by said comparator and the logical signals given by said control logic in order to adjust the speed of said machine;

a power amplifier having as an input value the signal given by said speed regulator, said amplifier controlling one of said electromagnetic clutches in order to apply a continually variable speed to said shaft of said machine; and a second power amplifier controlled by said logic by means of said speed regulator and operating another of said electromagnetic clutches in order to brake and position said shaft of said sewing machine.

5. Electronic equipment as defined in claim 4, wherein said voltage source energizes at the same time with a rectangular waveform voltage the said input device and with reference sawtooth voltage for chopping the said power amplifier at coupling.

6. Electronic equipment as defined in claim 5 wherein said contactless input device connected to the foot pedal of said sewing machine consists of:

a frame having sleeves at both ends;

a ferromagnetic shaft sliding axially in said frame and connected to said pedal;

a two springs system acting by compression, alternatively, restoring said ferromagnetic shaft into an initial position when the latter is displaced axially in one sensor or in an opposite sense;

a plurality of washers and rings ensuring the operation of said springs;

a primary coil energized by said rectangular waveform voltage;

a secondary coil magnetically coupled with said primary coil through said ferromagnetic shaft providing to its output an alternating voltage whose amplitude depends upon the displacement of said ferromagnetic shaft; and a connecting sleeve for said ferromagnetic shaft and said pedal.

7. Electronic equipment as defined in claim 5 wherein the speed and position transducer comprises:

a connecting sleeve mounted on the shaft of said machine;

a nonmagnetic shaft rigidly fastened to said connecting sleeve;

a support representing the fixed side of a transducer in which rotates said nonmagnetic shaft by means of two coaxial bearings;

an inductive armature mounted on said shaft and consisting of a sleeve of electroinsulating material, a magnet of ferrite magnetized radially and multipolar, fastened to said sleeve;

an inductive armature mounted on said support and consisting of:

at least one magnetic yoke of sheets;

a body surrounding each of said yokes;

coils for each of said bodies, each coil mounted on a respective body, these coils being connected so that each coil provides at its output an alternating voltage whose amplitude and frequency are proportional to the speed of said shaft of said machine;

ring-shaped permanent magnets of ferrite, axially magnetized for each position to be detected of said shaft of said machine, said magnets being mounted on said nonmagnetic shaft;

flux concentrators, one for each magnet, consisting of two ferromagnetic pieces disposed on both faces of said ring-shaped permanent magnet, between both concentrators being created an axial magnetic field; and Hall type magnetic sensors with incorporated amplifier for each said ring-shaped permanent magnet, said magnetic sensors being mounted on a support of said transducer and providing a voltage signal when said flux concentrator passes nearby said sensor.

8. Electronic equipment as defined in claim 4, wherein a control loop for continuous speed is formed by:

a first rectifying and filtering means;

threshold rectifying means ensuring a certain insensitiveness nearby the resting position of said controlling device;

resistive means which forms said comparator and adjustment potentiometers for the values minimum and maximum of the position speed;

a speed regulator consisting of an operational amplifier having proportional-integral-type reaction and adjustment potentiometer for the amplification coefficient, providing to its output a voltage proportional to the pressing of said pedal;

an operational amplifier having applied to its "−" input the voltage from the output of said speed regulator, and to its "+" input is applied the said triangular voltage from the said voltage source; to the output of said operational amplifier are obtained rectangular pulses of voltage having constant frequency and variable duration, depending on the displacement "forward" of said pedal;

said power amplifier coupled to the output of said operational amplifier.

9. Electronic equipment as defined in claim 4, wherein the stopping "up" or "down" of said shaft of said machine is performed when said pedal releases by means of:

two position switches, logical means, triggers and a monostable circuit incorporated in said logic;

said speed and position transducer means providing reference voltages for performing such control, as for the minimum speed effected independently by the driving of said pedal, said speed regulator which by braking ensures another value for the amplification coefficient, and said second power amplifier driving said braking electromagnetic clutch.

10. Electronic equipment as defined in claim 4, wherein the control for said presser foot lifting, for said thread loosening and for said thread cutting is performed by means of:

said controlling device, which pressed "back" commands said presser foot lifting and pressed "maximum back" commands said thread loosening and said thread cutting;

said first rectifying and filtering means creating a continuous level of voltage depending on said pressing of pedal;

a threshold means for the first step of voltage which by means of said logical block commands said presser foot lifting;

another threshold means for the second step of voltage; which, by means of said logical block ensures the voltage necessary for the thread loosening control and a single voltage pulse for said thread cutting; and power amplifiers controlling said presser foot lifting, said thread loosening and said thread cutting.

* * * * *